US007462070B2

(12) United States Patent
Fukushima

(10) Patent No.: US 7,462,070 B2
(45) Date of Patent: Dec. 9, 2008

(54) CONNECTOR HAVING LOCK MECHANISM

(75) Inventor: Takeshi Fukushima, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/878,682

(22) Filed: Jul. 26, 2007

(65) Prior Publication Data

US 2008/0032540 A1 Feb. 7, 2008

(51) Int. Cl.
*H01R 13/648* (2006.01)

(52) U.S. Cl. ..... 439/607; 439/350; 439/352

(58) Field of Classification Search ..... 439/350, 439/352, 607

See application file for complete search history.

(56) References Cited

U.S. PATENT DOCUMENTS 6,830,469 B1 * 12/2004 Doyle et al. ..... 439/247
2003/0104726 A1 * 6/2003 Masumoto ..... 439/607
2006/0121782 A1 * 6/2006 Shen et al. ..... 439/607

FOREIGN PATENT DOCUMENTS

JP 2004-327168 11/2004

* cited by examiner

*Primary Examiner*—Tho D Ta
(74) *Attorney, Agent, or Firm*—Kubotera & Associates, LLC

(57) ABSTRACT

A connector is provided with a lock mechanism for locking with a mating connector when the mating connector is fitted in the connector. The connector includes a housing and a metal shell for covering an upper surface, a lower surface, and side surfaces of the housing. The metal shell includes a fitting lock piece on a side portion of a fitting opening, and the fitting lock piece is arranged along a fitting direction with respect to the mating connector. The fitting lock piece includes a corresponding lock member for locking with a locking member of the mating connector when the mating connector is fitted in the connector through the fitting opening. The fitting lock piece engages an upper plate and a lower plate of the metal shell covering the upper surface and the lower surface of the housing, respectively.

13 Claims, 4 Drawing Sheets

CONNECTOR HAVING LOCK MECHANISM

BACKGROUND OF THE INVENTION

The present invention relates to a connector to be connected to a mating connector. More specifically, the present invention relates to a connector having a lock mechanism for locking a mating connector when the connector is connected to the mating connector.

Patent Reference has disclosed a conventional connector having a lock mechanism. FIG. 5 is a partially sectional perspective view showing the lock mechanism of the conventional connector disclosed in patent Reference.

Patent Reference: Japanese Patent Publication No. 2004-327168

The conventional connector is formed of a plug connector 100 and a receptacle connector 110. As shown in FIG. 5, the plug connector 100 has a lock lever 145 at a right front edge thereof, and the receptacle connector 110 has a lock mechanism at a right front edge thereof. Note that each of the plug connector 100 and the receptacle connector 110 has a shape symmetrical relative to a longitudinal direction thereof.

The receptacle connector 110 includes a housing 140 formed of an insulating material such as a resin; a plurality of terminals 125 arranged on the housing 140 with a specific pitch distance therebetween; a shell 160 for covering an outer portion of the housing; and a ground plate 120 disposed on a rear surface of the shell 160.

The receptacle connector 110 further includes a receptacle opening 200, and a bending portion (fitting lock piece) 163 is disposed in the receptacle opening 200. The bending portion 163 is bent outward from a part of the shell 160. The bending portion 163 has protruding portions 164 and 165 at a center portion thereof in a longitudinal direction thereof; edge portions 166 and 167 at a distal end portion thereof; and a lock hole 170 closer to a base portion thereof relative to the protruding portions 164 and 165.

The ground plate 120 includes a clip portion 127 at an edge portion thereof in a longitudinal direction thereof. The clip portion 127 includes an upper spring portion 128 and a lower spring portion 130. The upper spring portion 128 has a hole 129 and the lower spring portion 130 has a cut portion 131, respectively.

When the shell 160 is attached to the housing 140, the protruding portions 164 and 165 are fitted in a groove portion 150 and the like formed in the housing 140, so that the bending portion 163 is positioned in a lateral direction. Further, the edge portion 166 of the bending portion 163 is fitted in the hole 129 of the ground plate 120, and the edge portion 167 of the bending portion 163 is fitted in the cut portion 131 of the ground plate 120, so that the bending portion 163 is positioned in the receptacle connector 110 at a specific position.

The plug connector 100 is inserted into the receptacle connector 110 through the receptacle opening 200 in an arrow direction A. When the plug connector 100 is inserted into the receptacle connector 110, a hook portion 147 protruding inward from a distal end of the lock lever 145 contacts with the bending portion 163 of the receptacle connector 110, so that the lock lever 145 of the plug connector 100 deforms in an arrow direction B.

When the plug connector 100 is completely fitted in the receptacle connector 110, terminals (not shown) of the plug connector 100 contact with the terminals 125 of the receptacle connector 110. At this moment, the hook portion 147 of the lock lever 145 returns to an original posture in a direction opposite to the arrow direction B with an elasticity thereof. Accordingly, the hook portion 147 is fitted in the lock hole 170 of the receptacle connector 110, and the plug connector 100 is completely locked in the receptacle connector 110.

In the conventional connector described above, the bending portion 163 with the lock hole 170 is held in the groove 150 formed in the housing 140. Accordingly, when the plug connector 100 receives a twisting force in a lateral direction, it is difficult to stably hold the plug connector 100 with a large lock strength. In an extreme case, when the plug connector 100 receives a large twisting force, or the plug connector 100 is forcibly pulled out from the receptacle connector 110, the bending portion 163 may be pulled out before the lock is released.

Further, in the conventional connector, the bending portion 163 of the shell 160 is held with the clip portion 127 of the ground plate 120, i.e., a component completely separated from the shell 160. Accordingly, the conventional connector tends to have a complicated structure formed of a large number of components. When the component is held with the separate component, depending on a dimensional accuracy of the component, a position of other component such as the lock hole 170 may be shifted from a regular position after assembly.

In view of the problems described above, an object of the invention is to provide a connector capable of solving the problems. In particular, the connector has a structure in which a shell having a fitting lock piece is capable of increasing a lock strength.

Further objects of the invention will be apparent from the following description of the invention.

SUMMARY OF THE INVENTION

According to the present invention, a connector is provided with a lock mechanism for locking with a mating connector when the mating connector is fitted in the connector. The connector includes a housing and a metal shell for covering an upper surface, a lower surface, and side surfaces of the housing. A fitting opening is formed with the housing and the metal shell. The metal shell includes a fitting lock piece on a side of the fitting opening, and the fitting lock piece is arranged along a fitting direction with respect to the mating connector.

The fitting lock piece includes a corresponding lock member for locking with a locking member of the mating connector when the mating connector is fitted in the connector through the fitting opening. The fitting lock piece engages an upper plate and a lower plate of the metal shell covering the upper surface and the lower surface of the housing, respectively.

In the connector of the present invention, the fitting lock piece may be formed through bending an extending portion from a front side of the fitting opening toward a backside of the connector. The extending portion is formed through extending a part of the metal shell covering a side front surface of the housing.

In the connector of the present invention, the fitting lock piece may include protruding portions extending toward the upper surface and the lower surface of the housing. The protruding portions are fitted in holes or fitting portions formed in the upper plate and the lower plate of the metal shell, so that the fitting lock piece engages the housing.

In the connector of the present invention, the fitting lock piece may be formed through bending the extending portion toward inside the fitting opening. Alternatively, the fitting lock piece may be formed through bending the extending portion toward outside the fitting opening.

In the connector of the present invention, the fitting lock piece may be formed through bending the upper plate of the metal shell downward, or bending the lower plate of the metal shell upward.

In the connector of the present invention, the fitting lock piece may include a protruding portion extending toward the upper surface or the lower surface of the housing. The protruding portion is fitted in a hole formed in the upper plate or the lower plate of the metal shell, so that the fitting lock piece engages the housing.

In the connector of the present invention, the hole formed in the upper plate or the lower plate of the metal shell may be provided with a step portion formed around an edge thereof.

In the connector of the present invention, the fitting lock piece may be formed of a hole or a recess portion. Further, the protruding portions of the fitting lock piece may be situated above and below the lock hole.

According to the present invention, the fitting lock piece is held only with the metal shell. Accordingly, it is possible to increase locking strength while reducing the number of components.

DESCRIPTION OF THE PREFERRED EMBODIMENTS

Hereunder, embodiments of the present invention will be explained with reference to the accompanying drawings. In the explanation below, an electrical connector is used as an example. However, the present invention is not limited to the electrical connector, and may be applicable to, for example, an optical connector and the like. Accordingly, the present invention is not limited to the electrical connector.

Figure 1:
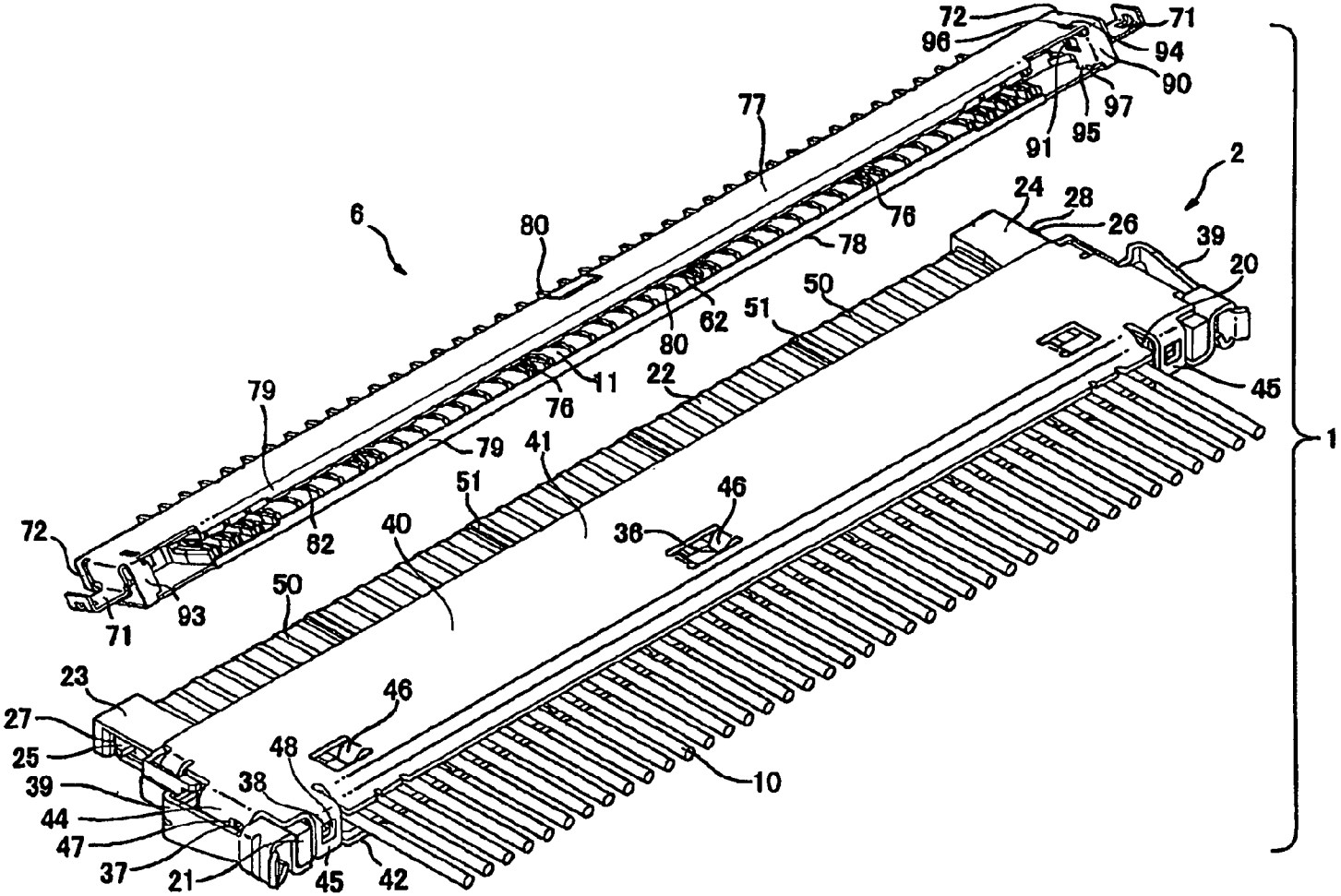
FIG. 1 is a perspective view showing an electrical connector according to an embodiment of the present invention.
Figure 2:
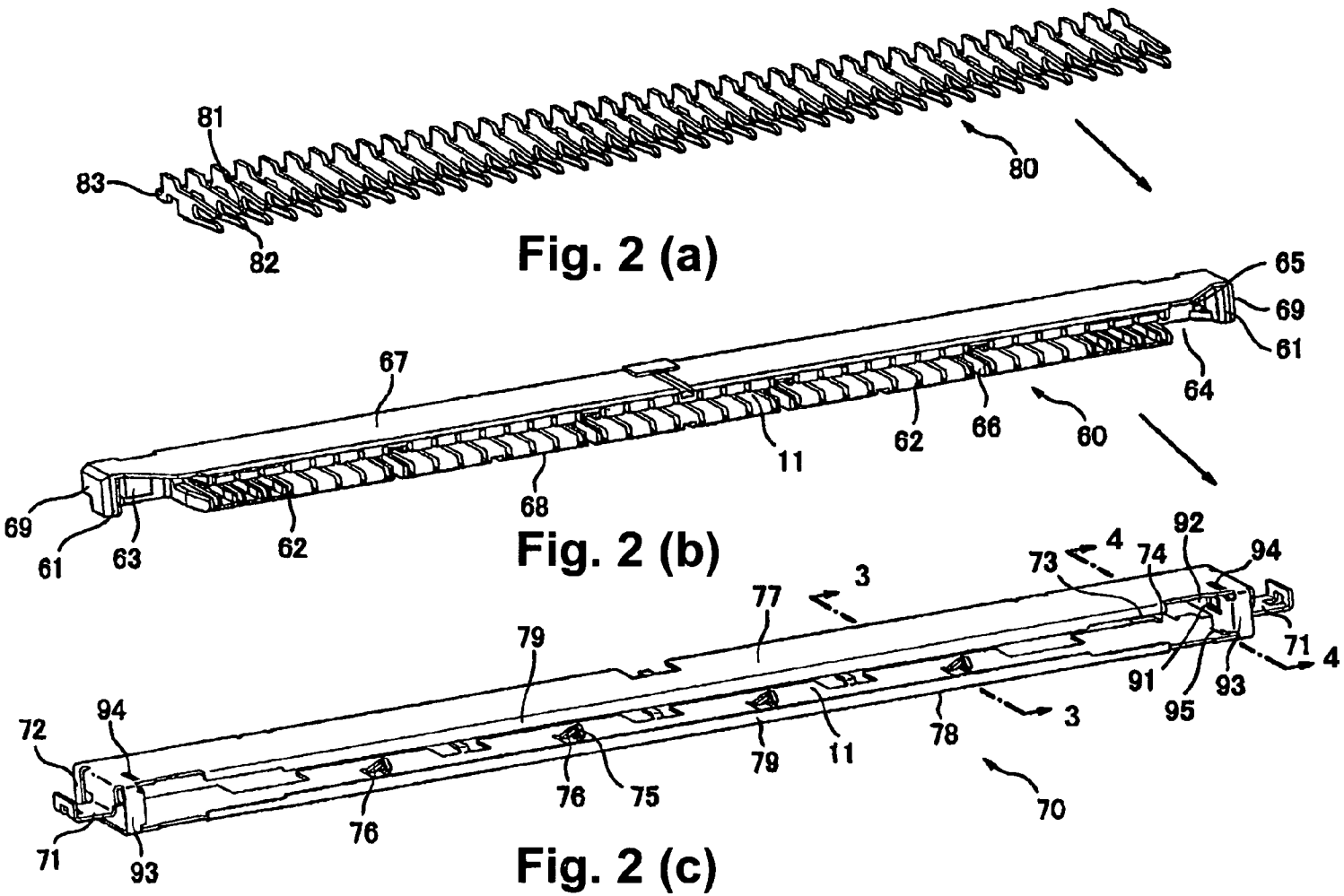
FIGS. 2(*a*) to 2(*c*) are exploded perspective views of a receptacle connector according to the embodiment of the present invention.
Figure 3:
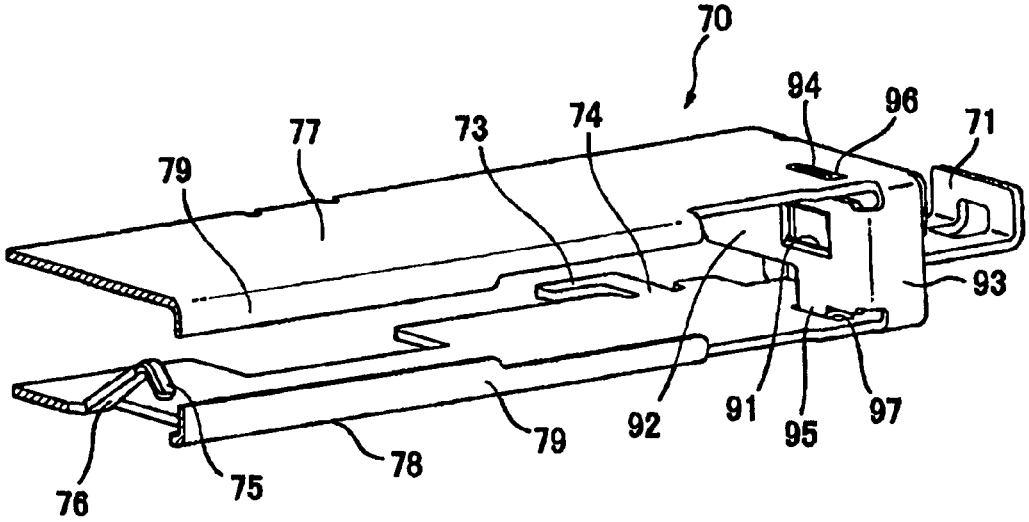
FIG. 3 is a sectional view taken along a line 3-3 in FIG. 2(*c*)
Figure 4:
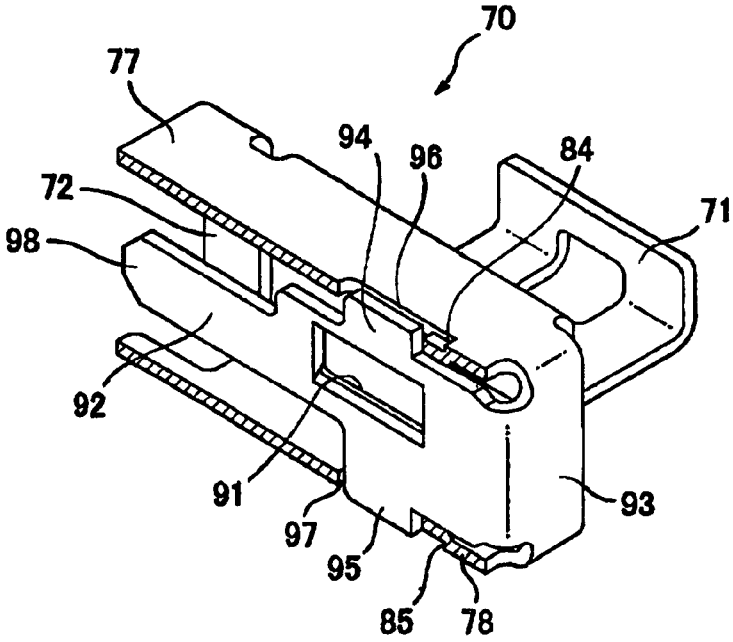
FIG. 4 is a sectional view taken along a line 4-4 in FIG. 2(*c*)

FIG. 1 is an upper surface perspective view of an electrical connector 1 according to an embodiment of the invention. FIGS. 2(*a*) to 2(*c*) are exploded perspective views of a receptacle connector 6. FIG. 3 is a sectional view taken along a line 3-3 in FIG. 2(*c*). FIG. 4 is a sectional view taken along a line 4-4 in FIG. 2(*c*).

The electrical connector 1 comprises a detachable plug connector (for cable connection) 2 and the receptacle connector (for board connection) 6. In operation, for instance, a receptacle connector 6 is fixed to a board. As clearly shown in FIG. 1, the plug connector 2 and the receptacle connector 6 have a symmetrical shape in a longitudinal direction thereof.

First, the plug connector 2 will be explained. The plug connector 2 mainly includes a plug housing 20 made of a resin; a plurality of male terminals 50 arranged and held in parallel with a specific interval therebetween inside of the plug housing 20; and a plug shell 40 made of metal covering an outer portion of the plug housing 20. Each of the male terminals 50 may provide each of a plurality of corresponding coaxial cables 10.

The plug housing 20 includes a housing 21 having a rectangular shape covered by the plug shell 40 in an approximate tubular shape and a fitting portion 22 protruding from the housing 21 in a fitting direction with respect to the receptacle connector 6. Upon fitting the plug connector 2 to the receptacle connector 6, the fitting portion 22 is inserted into the receptacle connector 6 through a fitting opening 11 of the receptacle connector 6.

End portions of the fitting portion 22 in a longitudinal direction are provided with guideposts 23 and 24 slightly protruding in the fitting direction with respect to the receptacle connector 6. Further, the guideposts 23 and 24 are provided with locking portions 25 and 26 protruding outward on both ends thereof. The locking portions 25 and 26 correspond to a hook portion 147 of a conventional connector shown in FIG. 5.

Figure 5:
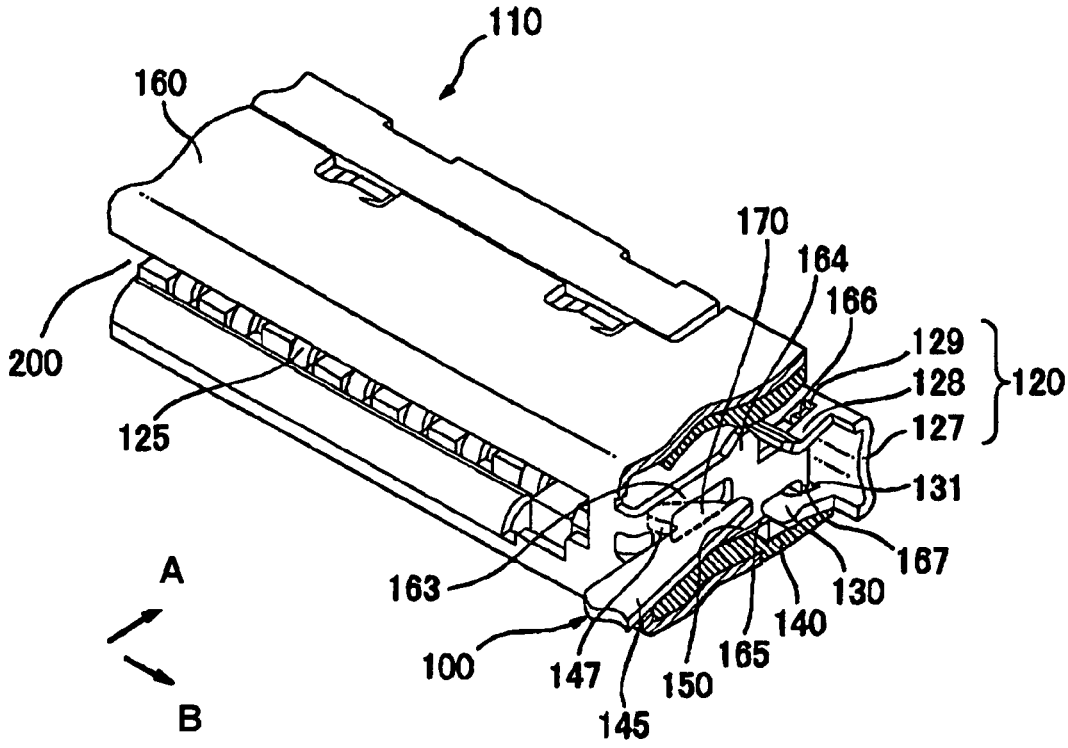
Fig. 5 Prior Art
FIG. 5 is a perspective view showing a conventional electrical connector having a lock mechanism.

Upon fitting the plug connector 2 to the receptacle connector 6, the locking portions 25 and 26 engage with locking holes 91 correspondingly formed in the receptacle connector 6 in a way similar to that of the conventional connector shown in FIG. 5, so that the plug connector 2 is locked to the receptacle connector 6. It should be noted that the hook portion 147 corresponding to the locking portions 25 and 26 face inward in the conventional connector shown in FIG. 5, while the locking portions 25 and 26 in the embodiment face outward.

The locking portions 25 and 26 have sloping surfaces 27 and 28 sloping toward a center portion of the fitting portion 22 in the fitting direction with respect to the receptacle connector 6. Further, horizontal sections of the locking portions 25 and 26 have an approximate right-angle triangle shape. The sloping surfaces 27 and 28 facilitate to lock with less force while ensuring locking tight.

The plug shell 40 comprises an upper surface portion 41 and a lower surface portion 42. In side surfaces and a back surface of the upper surface portion 41, side surface bent portions 44 and back surface bent portions 45 bent down vertically are provided. Further, in near center portions of the side surface bent portions 44 and the back surface bent portions 45, holes 47 and 48 are provided to engage with engagement indented portions 37 and 38 situated at corresponding positions of the plug housing 20.

In addition, three embedded fixed portions 46 to be embedded in embedding portions 36 situated at corresponding positions of the plug housing 20 are provided at specific intervals in the upper surface portion 41 of the plug shell 40.

When the plug shell 40 is attached to the plug housing 20, the engagement indented portions 37 and 38 of the housing 20 engage with the holes 47 and 48 of the plug shell 40, and the embedded fixed portions 46 of the plug shell 40 are fixed to the embedding portions 36 of the plug housing 20, thereby fixing the plug shell 40 to the plug housing 20. The lower surface portion 42 is fixed to the plug housing 20 in a way similar to that of the upper surface portion 41. Locking metal members 39 function as levers to unlock the locking portions 25 and 26 from the locking holes 91 of the receptacle connector 6. The locking metal members 39 are pressed to shift the locking portions 25 and 26 and thereby unlock.

A plurality of coaxial cables 10 (shown partially) is arranged in parallel along the fitting direction with respect to the receptacle connector 6 along housing grooves of the plug housing 20. Shielded lines are exposed at distal edges of the coaxial cables 10. The shielded lines are grounded through the plug shell 40, while each of the cable cores exposed at the distal portion of the coaxial cables 10 is fixed to the corresponding male terminal 50.

Next, the receptacle connector 6 will be explained. The receptacle connector 6 mainly comprises a receptacle housing 60 made of a resin, a plurality of female terminals 80 arranged and held in parallel with a specific interval therebetween inside the receptacle housing 60, and a receptacle shell 70 made of metal covering an outer portion of the receptacle housing 60.

In the receptacle connector 6, the receptacle housing 60 and the receptacle shell 70 provide the fitting opening 11 (FIG. 1). As indicated by arrows in FIGS. 2(*a*) to 2(*c*), in the receptacle connector 6, the female terminals 80 are pressed and fitted to the receptacle housing 60 from behind, and then the receptacle housing 60 is inserted into the receptacle shell 70 from behind to assemble the receptacle connector 6 with ease.

Receptacle spaces 63 and 64 are provided at both ends of the receptacle housing 60 in a longitudinal direction thereof to insert the guideposts 23 and 24 of the plug connector 2. In addition, the receptacle spaces 63 and 64 include rectangular holes 65, so that free edges 92 of locking pieces 90 are inserted backward into the rectangular holes 65 for positioning. The fitting lock pieces 90 are part of the receptacle shell 70.

The rectangular hole on the side of the receptacle space 63 (not shown) may be the same as the rectangular hole 65 because the receptacle connector 6 has a symmetrical shape. Further, in the receptacle housing 60, a plurality of terminal grooves 62 for corresponding female terminals 80 is provided along a fitting direction with respect to the plug connector 2. Notched portions 66 are also provided to arrange ground pieces 76 of the receptacle shell 70.

A board fixed portion 83 extending horizontally to fix to a board is provided at a rear edge of each of the female terminals 80. Further, distal edges of the female terminals 80 have an approximate U-shape in order to incorporate male terminals inside. An upper contacting portion 81 and a lower contacting portion 82 are provided in each of the female terminals 80 to contact with the male terminal 50 in upper and lower corresponding positions thereof in a height direction of the receptacle connector 6. That is, each of the female terminals 80 contacts with each of the male terminals 50 at two positions, thereby improving reliability of the connector.

The receptacle shell 70 is formed in the shape shown in FIG. 2(*c*) in advance by punching and bending or other methods. When the receptacle housing 60 is inserted into the receptacle shell 70, the receptacle shell 70 covers an upper surface 67, a lower surface 68, and side surfaces 69 of the receptacle housing 60 in an approximate tubular shape. After the receptacle housing 60 is inserted into the receptacle shell 70, back holding members 73 are raised vertically along the back surface of the receptacle housing 60 near roots 74, so that the receptacle shell 70 is fixed to the receptacle housing 60 in a front-to-rear direction. The back holding members 73 are provided at a rear of the bottom surface of the receptacle shell 70.

Similarly, side surface holding members 72 provided in a continuous state in an upper plate 77 of the receptacle shell 70 may be bent downward along the side surface 69 of the receptacle housing 60, so that the receptacle shell 70 is fixed to the receptacle housing 60 in a side surface direction. Specifically, front edges 79 of the receptacle connector 6 are bent inward of the fitting opening 11 from above and below. Accordingly, the front edges or bent portions 79 substantially improve strength against twisting of the plug connector 2. Further, fixed portions for board 71 are provided on the both ends of the receptacle shell 70 to connect the receptacle connector 6 to a board with solder.

In the receptacle shell 70, the fitting lock pieces 90 are provided. The fitting lock pieces 90 are formed by bending drawing portions inward from the front part of the fitting opening 11 to the back of the receptacle connector 6 and the inside of the fitting opening 11. The drawing portions are extended parts of front walls 93 formed to surround front walls 61 of the side surfaces 69 on the both ends of the receptacle housing 60. The fitting lock pieces 90 are arranged along the fitting direction of the plug connector 2. Further, the fitting lock pieces 90 are simply formed by bending and have an approximate tabular shape.

In the center areas of the front side (fitting position) of each of the fitting lock pieces 90 in a longitudinal direction thereof, the locking holes 91 are provided to engage with the locking portions 25 and 26 of the plug connector 2 upon fitting of the plug connector 2 through the fitting opening 11. Further, upper protruding portions 94 and lower protruding portions 95 are provided exactly above and below the locking holes 91. The upper protruding portions 94 and the lower protruding portions 95 are extended toward the upper surface 67 and the lower surface 68 of the receptacle housing 60. It is sufficient that the locking holes 91 engage with the locking portions 25 and 26. For example, the locking holes 91 may be simple dented portions (locking dented portion) instead of holes.

The upper protruding portions 94 and the lower protruding portions 95 are inserted into upper fixed holes (upper fitting portions) 96 and lower fixed holes (lower fitting portions) 97 of the upper plate 77 and a bottom plate 78 of the receptacle shell 70 covering the upper surface 67 and the lower surface 68 of the receptacle housing 60, respectively. Accordingly, the fitting lock pieces 90 are fixed to the receptacle housing 60 in a top-to-bottom direction thereof, thereby improving strength of the plug connector 2 against pull-out from the receptacle connector 6.

As described above, a part of the receptacle shell 70, i.e., the upper protruding portions 94 and the lower protruding portions 95, is used with corresponding upper fixed holes 96 and lower fixed holes 97 to improve the locking force of the fitting lock pieces 90 while reducing the number of parts. Further, it is possible to provide the upper fixed holes 96 and the lower fixed holes 97 at arbitral position in the receptacle shell 70, thereby making positioning stable.

Further, the upper protruding positions 94 and the lower protruding portions 95 of the fitting lock pieces 90 are retained and arranged within a thickness of the upper plate 77 and the bottom plate 78 of the receptacle shell 70 in the thickness direction of the receptacle connector 6 without protruding from the upper plate 77 and the bottom plate 78 of the receptacle shell 70. Accordingly, it is possible to improve strength without protrusions.

Further, steps 84 and 85 may be provided as depressed portions of the upper plate 77 and the lower plate 78 on the edges of the upper fixed holes 96 and the lower fixed holes 97, so that strength of the upper fixed holes 96 and the lower fixed holes 97 is improved without protrusions. The steps 84 and 85 may be formed through a pressing process with ease. Specifically, in the embodiment, the steps 84 and 85 are provided in the front part (near the front walls 93) of the receptacle connector 6 susceptible to a twisting force or the like.

The free edges 92 are stretched in a direction opposite to the base edge side of the fitting lock pieces 90 and are extended straight inward of the fitting opening 11. The free edges 92 are directly pressed into the rectangular holes 65 of the receptacle housing 60. Distal portions 98 of the free edges 92 may have a tapered shape to facilitate the press fit.

The receptacle connector 6 is grounded through fixing directly to a board. For example, a part of the bottom surface of the receptacle shell 70 is bent inward of the fitting opening 11 along the fitting direction of the plug connector 2 and the receptacle connector 6 to form the ground pieces 76 having free edges 75. The ground pieces 76 are arranged between the female terminals 80. When the ground pieces 76 are arranged between the female terminals 80, it is possible to reduce a size of the connector.

When the plug connector 2 is connected to the receptacle connector 6, the free edges 75 of the ground pieces 76 elastically contact with a back surface of ground surfaces 51, so that the board and the cables can be grounded. Further, the ground pieces 76 may be disposed not only on the bottom surface of the receptacle connector 6 but also anywhere on the upper surface or both surfaces. Also, the number of the ground piece 76 disposed is not limited. Similarly, the ground surfaces 51 of the corresponding plug connector 2 may be arranged between the male terminals 50 of the bottom surface, anywhere on the upper surface, or both surfaces.

In the embodiment, the fitting lock pieces 90 are formed through bending inward of the fitting opening 11. As in the conventional connector shown in FIG. 5, the fitting lock pieces 90 may be bent outward of the fitting opening 11. In this case, the upper plate 77 and the bottom plate 78 are further extended in the longitudinal direction and fix the upper protruding portions 94 and the lower protruding portions 95 provided in the fitting lock pieces.

In the embodiment, the locking pieces 90 are formed of the drawing portion of the front walls 93 covering the front walls 61 of the both ends of the receptacle housing 60. The locking pieces 90 may be formed by, for instance, bending side portions of the upper plate 77 and/or the bottom plate 78 of the receptacle shell 70. Further, the locking pieces 90 may be formed by bending drawing portions of the side portion of the upper plate 77 and/or the bottom plate 78 of the receptacle shell 70 extended to right and left sides or notched portions of side portions of the upper plate 77 and/or the bottom plate downwardly or upwardly in vertical direction.

When the locking pieces 90 are made by bending the side portions of the upper plate 77, portions equivalent to the upper protruding portions 94 may not be provided and only portions equivalent to the lower protruding portions 95 may be provided, thereby only one part in the lower side is fixed. Similarly, for instance, when the locking pieces 90 are made by bending the side portions of the bottom plate 78, portions equivalent to the lower protruding portions 95 may not be provided and only portions equivalent to the upper protruding portions 94 may be provided, thereby only one part in the upper side is fixed.

The portions pressed to fit into the rectangular holes 65 of the receptacle housing 60, or the free edges 92 of the fitting lock pieces 90, are not always necessary. For example, as far as the upper protruding portions 94 and the lower protruding portions 95 of the locking pieces 90 are capable of being inserted into the upper plate 77 and the bottom plate 78 of the receptacle shell 70, the free edges 92 or surrounding areas thereof may be omitted.

The present invention is not limited to the electrical connectors, and may be applied to various connectors with a locking mechanism.

The disclosure of Japanese Patent Application No. 2006-209864, filed on Aug. 1, 2006, is incorporated in the application by reference.

While the invention has been explained with reference to the specific embodiments of the invention, the explanation is illustrative and the invention is limited only by the appended claims.

What is claimed is:

1. A connector to be connected to a mating connector, comprising:

a housing having a receptacle space for receiving the mating connector;

a metal shell having an upper plate and a lower plate for covering the housing; and a fitting lock piece disposed in a side of the receptacle space and attached to the upper plate and the lower plate, said fitting lock piece having an engaging portion for engaging a corresponding engaging portion of the mate connector when the mating connector is fitted in to connector, said fitting lock piece further including an upper protruding portion and a lower protruding portion, said upper protruding portion being fitted in an upper fitting portion formed in the upper plate, said lower protruding portion being fitted in a lower fitting portion formed in the lower plate.

2. The connector according to claim 1, wherein said fitting lock piece extends downward from the upper plate.

3. The connector according to claim 1, wherein said fitting lock piece extends upward from the lower plate.

4. The connector according to claim 1, wherein at least one of said upper fitting portion and said lower fitting portion includes a step portion.

5. The connector according to claim 1, wherein said engaging portion is formed of a hole.

6. The connector according to claim 1, wherein said engaging portion is formed of a cut portion.

7. The connector according to claim 1, wherein said upper protruding portion and said lower protruding portion are situated at positions above and below the engaging portion, respectively.

8. The connector according to claim 1, wherein said metal shell further includes a front end portion connecting the upper plate and the lower plate, said fitting lock piece extending from the front end portion backward from a front side of the receptacle space.

9. The connector according to claim 8, wherein said fitting lock piece extends from the front end portion inside the receptacle space.

10. The connector according to claim 8, wherein said fitting lock piece extends from the front end portion outside the receptacle space.

11. The connector according to claim 1, wherein said fitting lock piece further includes at least one of an upper protruding portion and a lower protruding portion, said upper protruding portion being fitted in an upper fitting portion formed in the upper plate, said lower protruding portion being fitted in a lower fitting portion formed in the lower plate.

12. The connector according to claim 11, wherein at least one of said upper fitting portion and said lower fitting portion includes a step portion.

13. The connector according to claim 11, wherein at least one of said upper protruding portion and said lower protruding portion is situated at a position above or below the engaging portion.

* * * * *